US005127696A

United States Patent [19]

Awano et al.

[11] Patent Number: 5,127,696

[45] Date of Patent: Jul. 7, 1992

[54] WEDGE TYPE GRIP

[75] Inventors: Takashi Awano, Uji; Takashi Kitaoka, Ukyo, both of Japan

[73] Assignee: Shimadzu Corporation, Kyoto, Japan

[21] Appl. No.: 627,960

[22] Filed: Dec. 17, 1990

[51] Int. Cl.[5] ..... B66C 1/44

[52] U.S. Cl. ..... 294/102.1

[58] Field of Search ..... 294/102.1, 102.2, 114, 294/115

[56] References Cited

U.S. PATENT DOCUMENTS

| | | | |
|---|---|---|---|
| 2,229,800 | 1/1941 | Dean | 294/114 X |
| 2,347,361 | 4/1944 | Nelson . | |
| 2,559,223 | 7/1951 | Murray . | |
| 2,699,589 | 1/1955 | Redell | 294/102.1 |
| 2,702,929 | 3/1955 | Laddon et al. . | |
| 3,092,414 | 6/1963 | Janoff | 294/102.1 |

FOREIGN PATENT DOCUMENTS

| | | | |
|---|---|---|---|
| 760087 | 5/1971 | Belgium . | |
| 7622739 | 7/1976 | France . | |
| 1040045 | 9/1983 | U.S.S.R. | 294/102.1 |
| 821075 | 9/1959 | United Kingdom . | |
| 899752 | 6/1962 | United Kingdom | 294/102.2 |
| 1496575 | 12/1977 | United Kingdom . | |

*Primary Examiner*—Margaret A. Focarino
*Assistant Examiner*—Dean J. Kramer
*Attorney, Agent, or Firm*—Wegner, Cantor, Mueller & Player

[57] ABSTRACT

A wedge type grip has a pair of wedge-shaped jaws and corresponding inclined faces of a yoke, the inclined faces of the jaws being in slidable contact with the corresponding faces of the yoke. The improved grip is provided with a mechanism for effecting relative movement between the yoke and the jaws along the axis of loading, a motor for applying a driving force to the mechanism to operate the same, and means for reducing the output speed of the motor and transferring the reduced output to the mechanism.

4 Claims, 2 Drawing Sheets

WEDGE TYPE GRIP

BACKGROUND OF THE INVENTION

This invention relates to a wedge type grip for use in material testing machines, which is provided with a pair of wedge-shaped gripping members or jaws for holding a specimen to be tested.

FIG. 3 diagramatically shows a known wedge type grip comprising a grip frame or yoke 10 and a pair of wedge-shaped gripping members or jaws 20A and 20B which will be designated by only the numeral 20 without the suffix A or B when it is not necessary to discriminate between the two members 20A and 20B. The yoke 10 is formed with an inner space 3 which gradually expands from its entrance 1 toward its inner end 2, with a pair of inclined faces 11 formed opposite to each other and symmetrically with respect to an axis X of loading. Each of the jaws 20A and 20B is formed with an inclined outer lateral face 201 matching with the corresponding one of the inclined faces 11 of the yoke 10, and the jaws 20 are placed in the space 3 with their faces 201 in slidable contact with the corresponding inclined faces 11 of the yoke 10. When the yoke 10 is moved upwardly in the figure relative to the jaws 20, the jaws are tightened to grip a specimen S, and when the yoke 10 is moved in the opposite direction, that is, downwardly in the figure, the jaws are loosened to release the specimen. The relative movement of the yoke 10 and the jaws is conducted by hand or a hydraulic cylinder.

The grips of the above-mentioned manual and hydraulic types have the following disadvantages.

In the manual type, since a handle is manually rotated to move the yoke relative to the jaws to grip or release a specimen, the operation is troublesome and it is difficult to have a sufficient gripping force.

In the hydraulic type, it is easy to operate the grip since mere handling of a selector valve suffices to supply or discharge pressure oil or air into or from the cylinder thereby to effect relative movement of the yoke and jaws of the grip. With pressurized air, however, it is impossible to obtain a sufficient gripping force. With pressure oil it is possible to obtain a large gripping force. To obtain a large gripping force, however, it is necessary to provide a source of pressure oil capable of producing a high pressure and a hydraulic cylinder of a large diameter resistive to high pressure, so that the whole device becomes bulky with a high manufacturing cost. In addition, since the pressure oil in the cylinder is blocked by means of a selector valve while the grip is holding a specimen, leakage of pessure oil will cause the gripping force to decrease.

Accordingly, the primary object of the invention is to provide a wedge type grip which is compact in size and capable of providing a large gripping force and has good operability.

SUMMARY OF THE INVENTION

Briefly stated, the device of the invention comprises:

a yoke having a pair of spaced-apart, opposed faces so inclined symmetrically with respect to the axis of loading as to define therebetween an inner space gradually expanding from the entrance of the space toward the inner end thereof;

a pair of wedge-shaped jaws each having an inclined outer lateral face matching with the corresponding one of the inclined faces of the yoke, the jaws being disposed in the inner space of the yoke so that the inclined faces of the jaws are in slidable contact with the corresponding inclined faces of the yoke;

a mechanism for effecting relative movement between the yoke and the jaws along the axis of loading;

a motor for applying a driving force to the mechanism to operate it; and means for reducing the output speed of the motor and transferring the reduced output to the mechanism.

In operation, the output speed of the motor is reduced and applied to the mechanism for effecting relative movement between the yoke and the jaws, so that the mechanism operates to move the yoke relative to the jaws thereby to cause the jaws to be closed by wedge action and hold a specimen therebetween with a predetermined gripping force. Since the output speed of the motor is reduced to move the yoke, a large gripping force is obtained with a compact device.

The invention will be described below in detail with reference to the accompanying drawing.

PREFERRED EMBODIMENT OF THE INVENTION

Figure 1:
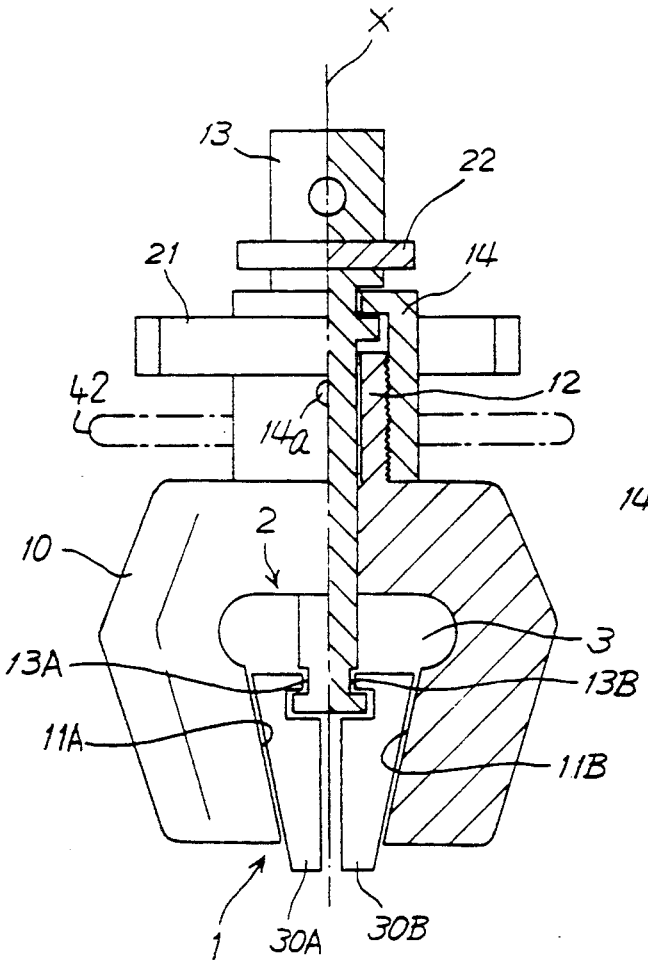
FIG. 1 is a front view of one embodiment of the invention with the right half thereof shown in vertical section.

Referring to FIG. 1, there is shown a yoke generally designated by 10 and having a pair of spaced-apart, opposed faces 11A and 11B so inclined symmetrically with respect to an axis X of loading as to define therebetween a space 3 gradually expanding from the entrance opening 1 of the space 3 toward the inner end 2 thereof. The inclined faces 11A and 11B will be designated by only the numeral 11 without the suffix A or B when it is not necessary to discriminate between the two faces 11A and 11B. The yoke 10 is provided with an externally threaded hollow cylindrical member 12 projecting from the upper surface of the yoke 10 and an inlet port **10*a* extending from the outer surface of the yoke 10 to the inner space 3** thereof.

In the inner space 3 of the yoke 10 there are provided a pair of wedge-shaped gripping members or jaws 30A and 30B, which will be designated by only the numeral 30 without the suffix A or B when it is not necessary to discriminate between the two members 30A and 30B.

A rod 13 extends through the hollow cylindrical member 12 and is provided at the inner end thereof with a pair of recesses 13A and 13B, in which the jaws 30A and 30B engage, respectively, so that the position of the jaws along the axis X of loading is kept stationary. The rod 13 is fixed to a frame, not shown, so as not to be rotatable.

A cap nut 14 is rotatably supported by the rod 13 and threaded on the hollow cylindrical member 12 of the yoke 10, so that rotation of the cap nut 14 causes the yoke 10 to move axially relative to the jaws 30.

Figure 2:
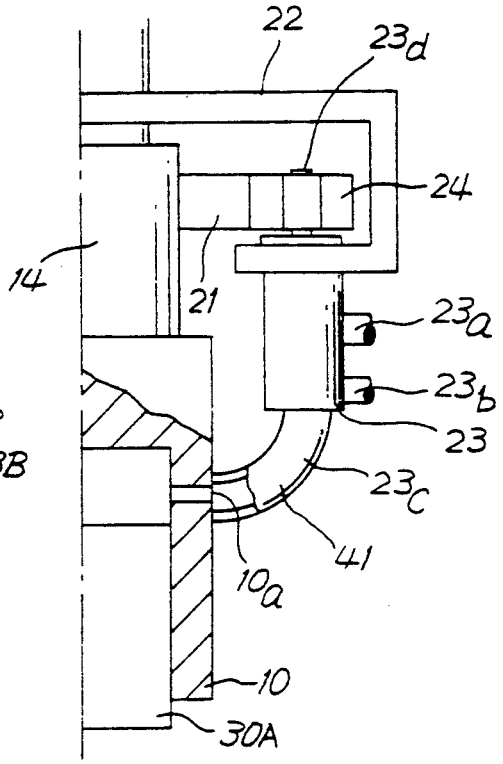
FIG. 2 is a right side view, partly in vertical section, of the device of FIG. 1.
Figure 3:
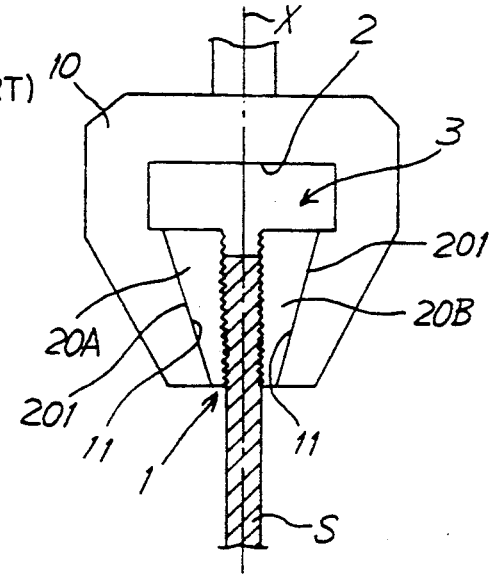
Fig. 3 (PRIOR ART)
FIG. 3 is a front view of a conventional wedge type grip.

The cap nut 14 is formed with a through hole **14*a* for mounting a manual handle 42 on the cap nut. A large gear 21 is fixed to the cap nut 14 for rotation therewith. As shown in FIG. 2, a bracket 22 extends perpendicularly from the rod 13 at one side thereof and supports an air pressure motor 23. A small gear 24 is fixed to the output shaft 23***d* of the motor 23 and meshes with the large gear 21 fixed to the cap nut 14. The number of the teeth of the small gear 24 is smaller than that of the large gear 21. The motor 23 is provided with a pair of inlet ports 23*a* and 23*b*, through one of which, say, 23*a*, pressurized air is fed into the motor 23 to rotate it in one direction, and pressurized air supplied to the motor 23 through the other port, say, 23*b* rotates the motor in the opposite direction. The motor 23 is provided with a discharge port 23*c* which communicates with the supply port 10*a* formed in the yoke 10 through a hose 41.

In the illustrated embodiment, the hollow cylindrical member 12 and the cap nut 14 threaded thereon constitute a mechanism for moving the yoke 10 relative to the jaws 30, and the small and large gears 24 and 21 meshing with each other constitute a reduction gear.

In operation, when pressurized air is supplied through the inlet port 23*b* to the motor 23, the motor is rotated to rotate the cap nut 14 through the small and large gears 24 and 21, so that the yoke 10 is lowered relative to the jaws 30 held stationary in vertical direction thereby to open the jaws. One end of a specimen S is inserted between the open jaws, and pressurized air is supplied through the other port 23*a* to the motor, whereupon the cap nut 14 is rotated in the opposite direction, so that the yoke 10 is raised thereby to close the jaws, which grip the specimen with a force of a predetermined strength. Since the output speed of the motor 23 is reduced by the combination of the small and large gears 24 and 21, a sufficiently large clamping torque of the cap nut 14 is obtained. Thus a required gripping force can be obtained with a small motor.

When a tension test is conducted on a specimen with its opposite ends held by a pair of grips of the above-mentioned design in the above-mentioned manner, the jaws 30 of the upper grip are pulled downwardly so that the yoke 10 is raised relative to the jaws 30 thereby to increase the gripping force. Since the yoke 10 is connected to the output of the motor 23 through the reduction gear, it seldom happens that a pulling counterforce causes the motor to rotate in the reverse direction thereby to decrease the gripping force.

When the test has been finished, pressurized air is supplied to the motor 23 through the port 23*b* thereby to open the jaws 30, whereupon the specimen S is taken out of the grip.

When the jaws are opened or closed, the air discharged from the motor 23 through the discharge port 23*c* is led through the hose 41 and the inlet port 10*a* into the space 3 in the yoke 10 so as to blow any dust out of the space 3. However, this feature is not essential for the present invention.

Figure 4:
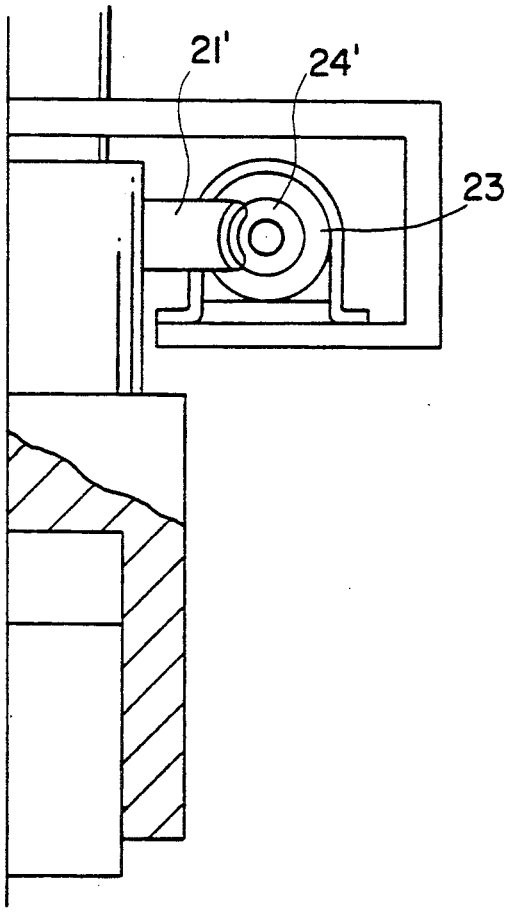
FIG. 4 is a view similar to FIG. 2 for the purpose of illustrating gearing of the worm drive type.

Since the object of the invention is to provide a grip in which the driving speed of a motor is reduced to move the yoke relative to the gripping members thereby to obtain a large gripping force with a small device, the motor may not only be of air pressure type but also of any other type such as a hydraulic or an electrical type. In the illustrated embodiment, the reduction gear comprises a pair of spur gears, it may also be a worm gear type. In FIG. 4, motor 23 drives worm gear 24' which, in turn, meshes with and drives worm wheel 21'. The mechanism for effecting relative movement between the yoke and the jaws comprises an external and an internal thread meshing with each other. It may also be a rack-and-pinion mechanism.

In accordance with the invention, since the output speed of the motor is reduced to move the yoke relative to the jaws, it is possible to provide a large gripping force with a compact device at a low cost without using a large source of pressure oil or a large cylinder. Since the pulling counterforce of the yoke is prevented by the reduction gear from being transferred onto the motor, it seldom happens that a counterforce produced upon pulling of a specimen causes the motor to rotate in the reverse direction thereby to reduce the gripping force of the jaws.

What we claim:

1. A wedge type grip comprising:

a yoke having a pair of spaced-apart, opposed faces so inclined symmetrically with respect to an axis of loading as to define therebetween an inner space gradually expanding from an entrance of said inner space toward an inner end thereof and an externally threaded hollow cylindrical member projecting axially from said yoke and away from said inner space;

a pair of wedge-shaped jaws each having an inclined outer lateral face matching with a corresponding one of said inclined faces of said yoke, said jaws being disposed in said inner space of said yoke so that said inclined faces of said jaws are in slidable contact with said corresponding inclined faces of said yoke;

a mechanism for effecting relative movement between said yoke and said jaws along said axis of loading, said mechanism having a rod extending through said hollow cylindrical member with one end of said rod being engaged by said pair of jaws in said inner space and an opposite end exposed outside said hollow cylindrical member and a cap nut with an internal threading, said cap nut being threaded onto said hollow cylindrical member and rotatable relative thereto;

a motor for applying a driving force to said mechanism in order to operate said mechanism; and means for reducing an output speed of said motor to a reduced output and transferring said reduced output to said mechanism.

2. The device of claim 1, wherein said reducing means comprises:

a first gear fixed to an output of said motor, and a second gear fixed to said cap nut, the second gear having a greater number of teeth than the first gear.

3. The device of claim 2, wherein said first and second gears are spur gears.

4. The device of claim 2, wherein said first gear is a worm, and said second gear is a worm wheel.

* * * * *